US010163546B2

(12) United States Patent
Hofstetter et al.

(10) Patent No.: US 10,163,546 B2
(45) Date of Patent: Dec. 25, 2018

(54) FIELD CONTROL DEVICE AND HIGH-VOLTAGE SYSTEM HAVING A FIELD CONTROL DEVICE

(71) Applicant: SIEMENS AKTIENGESELLSCHAFT, Munich (DE)

(72) Inventors: Michael Hofstetter, Munich (DE); Jochen Schaefer, Kersbach (DE); Andreas Philipp, Winkelhaid (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/780,970

(22) PCT Filed: Nov. 1, 2016

(86) PCT No.: PCT/EP2016/076277
§ 371 (c)(1),
(2) Date: Jun. 1, 2018

(87) PCT Pub. No.: WO2017/092942
PCT Pub. Date: Jun. 8, 2017

(65) Prior Publication Data

US 2018/0268963 A1 Sep. 20, 2018

(30) Foreign Application Priority Data

Dec. 1, 2015 (DE) ..... 10 2015 223 947

(51) Int. Cl.
*H01T 19/02* (2006.01)
*H01B 7/42* (2006.01)

(52) U.S. Cl.
CPC ..... *H01B 7/423* (2013.01); *H01T 19/02* (2013.01)

(58) Field of Classification Search
CPC ..... H01B 7/423; H01T 19/02
(Continued)

(56) References Cited

U.S. PATENT DOCUMENTS 8,901,790 B2 * 12/2014 Salamah ..... H02K 5/15 310/54
2010/0294562 A1 11/2010 Dais et al.
(Continued)

FOREIGN PATENT DOCUMENTS

DE 905156 C 2/1954
DE 1465293 A1 4/1969
(Continued)

*Primary Examiner* — Timothy Thompson
*Assistant Examiner* — Michael F McAllister
(74) *Attorney, Agent, or Firm* — Laurence Greenberg; Werner Stemer; Ralph Locher

(57) ABSTRACT

A field control device for a high-voltage system includes a shielding element for field control, which can be connected to an electrical conductor of the high-voltage system in an electrically conductive manner and, when connected to the conductor, at least partly delimits a weak-electric-field spatial region. A cooling body, which can be connected to the electrical conductor in a thermally conductive manner and which is disposed within the weak-field spatial region, has an outer surface area which is greater than an outer surface area of the shielding element. A high-voltage system having the field control device is also provided.

8 Claims, 2 Drawing Sheets

(58) Field of Classification Search
USPC ..... 174/15.2
See application file for complete search history.

(56) References Cited

U.S. PATENT DOCUMENTS

| | | | | |
|---|---|---|---|---|
| 2011/0180292 | A1* | 7/2011 | Widmer ..... | H01H 33/42<br>174/15.2 |
| 2012/0205074 | A1 | 8/2012 | Frigiere et al. | |
| 2015/0249331 | A1 | 9/2015 | Gottschalk et al. | |

FOREIGN PATENT DOCUMENTS

| | | | |
|---|---|---|---|
| EP | 2711939 | B1 | 12/2014 |
| JP | H11113245 | A | 4/1999 |

* cited by examiner

FIELD CONTROL DEVICE AND HIGH-VOLTAGE SYSTEM HAVING A FIELD CONTROL DEVICE

BACKGROUND OF THE INVENTION

Field of the Invention

The invention relates to a field control device for a high-voltage system having a shielding element for a field control procedure and said shielding element may be connected in an electrically conductive manner to an electrical conductor of the high-voltage system and when said shielding element is connected to the conductor said shielding element delimits at least in part a spatial region that has a weak electric field.

Field control devices of this type are known from the prior art. They are mostly used for producing a favorable distribution of an electric field in the proximity of the electrical conductor and/or for minimizing the risk of corona discharges.

By way of example, EP 2 711 939 B1 describes a field control device that is in the form of a control ring and is arranged on an end of a line arrester of a high-voltage system, said end lying on the high-voltage potential. The control ring is used so as to ensure the voltage is uniformly distributed over the structural length of the line arrester. Furthermore, EP 2 711 939 B1 discloses a further field control device in the form of a corona ring that is arranged on a ground-side end of the line arrester. The corona ring is used so as to electrically shield sharp-edged fastening elements of the line arrester. It is possible in this manner using the known field control devices to increase the reliability of the high-voltage system.

SUMMARY OF THE INVENTION

The object of the invention is to improve the field control device of this type for a high-voltage system in such a manner that it is possible to further increase the reliability of the high-voltage system.

The object is achieved in the case of a field control device of this type by means of a cooling body that may be connected in a heat conducting manner to the electrical conductor and is arranged within the weak-field spatial region and the outer surface area of said cooling body is greater than an outer surface area of the shielding element. In this context, any current-carrying component of the high-voltage system is understood to be an electrical conductor.

It is possible using the additional cooling body for the field control device in accordance with the invention to fulfill a further function for the high-voltage system in an advantageous manner, namely the cooling function. When the high-voltage system is being operated at high currents, by way of example in the nominal range, increased temperatures occur as a result of the particular operation. These increases in temperature may be up to several tens of Kelvin. They occur both at the electrical conductors, in particular at busbars, and also at connected components, by way of example at measurement resistors and the like. Above all, it is possible in conjunction with higher ambient temperatures as a consequence for considerable temperatures to occur at the components. These may cause problems when designing the components, by way of example if precise measurement values are required at the measurement resistor. This has the end effect that the reliability of the entire high-voltage system is reduced. As a result of an inadequate outer surface area, it is not possible to dissipate heat effectively via the shielding element or the electrical conductor itself. At the same time, the shielding element is fastened to the electrical conductor mainly using relatively thin fastening rods that are used exclusively to provide mechanical stability and are likewise not suitable to dissipate heat effectively. In contrast, it is possible to dissipate heat effectively using the additional cooling body. As a result of the relatively large outer surface area, this is more effective than dissipating heat merely by means of the shielding element and/or the electrical conductor itself.

At the same time, the field characteristics in the environment of the field control device in accordance with the invention do not change because the cooling body is located in the weak-field spatial region. The electric field in the weak-field spatial region is at least a factor 100 less that outside the weak-field spatial region. The risk of partial discharges is thus advantageously minimized. The additional cooling body is produced in an expedient manner from a material that has good heat-conducting characteristics, by way of example from a metal. The spatial expansion of the weak-field spatial region is essentially determined by means of the geometry of the electrically conductive elements, i.e. shielding elements, which delimit said spatial region.

In the context of the present invention, the term 'high voltage' is understood to mean a voltage of more than 1 kV.

In an expedient manner, the outer surface area of the cooling body is to be as large as possible in order to dissipate the heat effectively. The term 'outer surface area' is understood in this case to mean the surface area of the cooling body or other components that is in direct contact with the air that surrounds the high-voltage system. For this reason, it is of advantage if the outer surface area of the cooling body is at least twice the size, preferably in an advantageous manner five times the size, of the outer surface area of the shielding element. It is naturally also possible to provide multiple part cooling bodies in order to increase the outer surface area further.

It is preferred that the cooling body comprises a ribbed structure that increases the size of the outer surface area. For this purpose, the cooling body may comprise by way of example plates that are arranged in a parallel manner. These plates may be planar or lamella-shaped or rippled so that the outer surface area is further increased.

The cooling body in accordance with one embodiment of the invention is a passive cooling body. Accordingly, the cooling body does not comprise any components that actively support the dissipation of heat, such as by way of example fans or pumps. A particularly simple and cost-effective cooling body is provided in this manner.

It is preferred that the field control device is configured as one piece. It may be produced by way of example using an extrusion molding procedure or in a 3d printer. A field control device of this type comprises in particular good mechanical stability characteristics. As an alternative, it is conceivable to connect the cooling body to the remaining components of the field control device using a welding procedure with the result that the field control device is in two parts or multiple parts.

The cooling body in accordance with one advantageous embodiment of the invention comprises a reflecting outer surface. It is possible by means of the reflecting outer surface, by way of example by means of appropriate polishing, to minimize the extent to which the cooling body is warmed by the sun's rays. It is likewise conceivable to provide further measures such as shielding the cooling body against the sun by means of canopies or similar.

It is preferred that the field control device also comprises at least one heat pipe element that is connected in a heat-conducting manner to the cooling body or the shielding element and may be connected in a heat-conducting manner to the electrical conductor. Heat-pipe elements are known to the person skilled in the art. They are commercially available and use as a cooling principle an evaporating fluid in the interior of a mostly elongated container that is suitable for this purpose. The heat-pipe element may be realized as an additional component or also integrated in one of the already existing components, by way of example one of the mechanical supports, the cooling body or even the electrical conductor itself. The heat dissipation is further improved in this manner.

The shielding element in accordance with one embodiment of the invention comprises a corona ring that comprises a shielding ring and supporting elements so as to connect the shielding ring to the high-voltage system. It is possible particularly within the scope of this embodiment to realize the field control device in conjunction with components of the high-voltage system that are already being used, as a result of which it is possible to realize a particularly cost-effective field control device.

It may be of advantage if at least one supporting element comprises a heat-pipe element. The supporting element may be replaced in particular by a suitably shaped heat-pipe element.

Moreover, the invention relates to a high-voltage system having a field control device having a shielding element for the field control procedure and said shielding element may be connected in an electrically conductive manner to an electrical conductor of the high-voltage system and when said shielding element is connected to the conductor said shielding element delimits at least in part a weak electric field spatial region.

As already mentioned, such a high-voltage system is known by way of example from EP 2 711 939 B1.

The object of the present invention is to propose a high-voltage system of this type that is as reliable as possible.

The object is achieved in the case of a high-voltage system of this type by virtue of the fact that the field control device comprises a cooling body that may be connected in a heat-conducting manner to the electrical conductor and said cooling body is arranged within the weak-field spatial region and the outer surface area of said cooling body is greater than an outer surface area of the shielding element.

The advantages of the high-voltage system in accordance with the invention arise from the previously described advantages of the field control device in accordance with the invention.

All described embodiments of the field control device in accordance with the invention may also be used in particular in conjunction with the high-voltage system in accordance with the invention.

BRIEF DESCRIPTION OF THE SEVERAL VIEWS OF THE DRAWING

The invention is further explained below with reference to exemplary embodiments illustrated in FIGS. 1 and 2.

DESCRIPTION OF THE INVENTION

Figure 1:
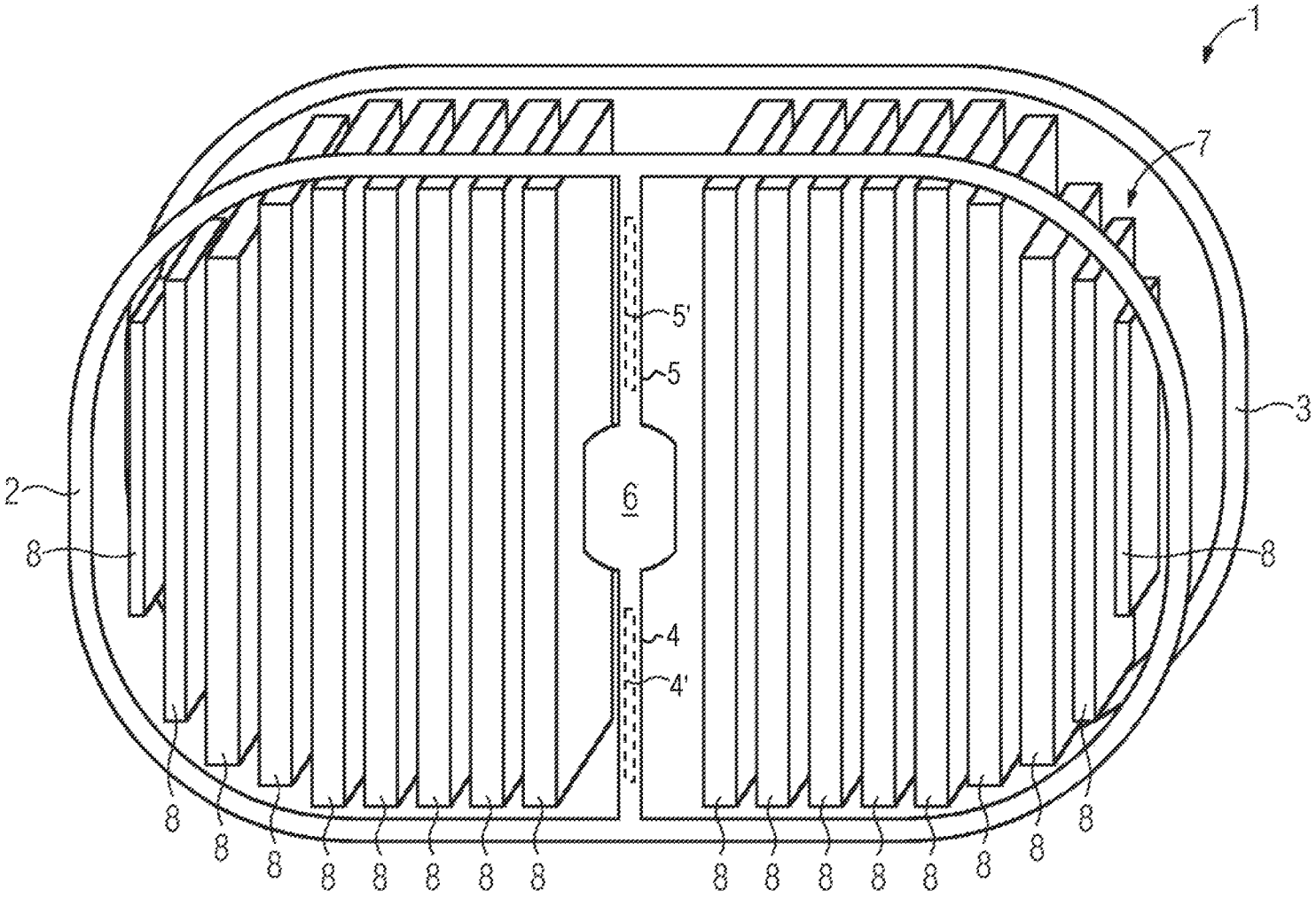
FIG. 1 illustrates a schematic view of an exemplary embodiment of a field control device in accordance with the invention.

An exemplary embodiment of a field control device 1 in accordance with the invention is illustrated in detail in FIG. 1. The field control device 1 comprises a first shielding element 2 in the form of a corona ring and also a second shielding element 3 that is likewise in the form of a corona ring. The first shielding element 2 is connected by supporting elements 4, 5, in a mechanical and electrically conductive manner to a fastening element 6 for fastening to a busbar of a high-voltage system. Heat-pipe elements 4', 5' are respectively disposed within the supporting elements 4, 5. Consequently, when it is connected to the busbar, the first shielding element 2 is on the same electrical potential as the busbar. The same also applies for the second shielding element 3, wherein in this case the struts are not visible in the illustration in FIG. 1.

The first and the second shielding element 2, 3 delimit a spatial region that is essentially free of the electric field. A cooling body 7 is arranged in this field-free or weak-field spatial region, wherein the cooling body 7 is connected to the busbar in an electrical and heat-conducting manner.

The cooling body 7 comprises ribs 8 that are arranged parallel to one another and are connected to one another and in the form of planar plates said ribs almost completely fill the weak-field spatial region.

Figure 2:
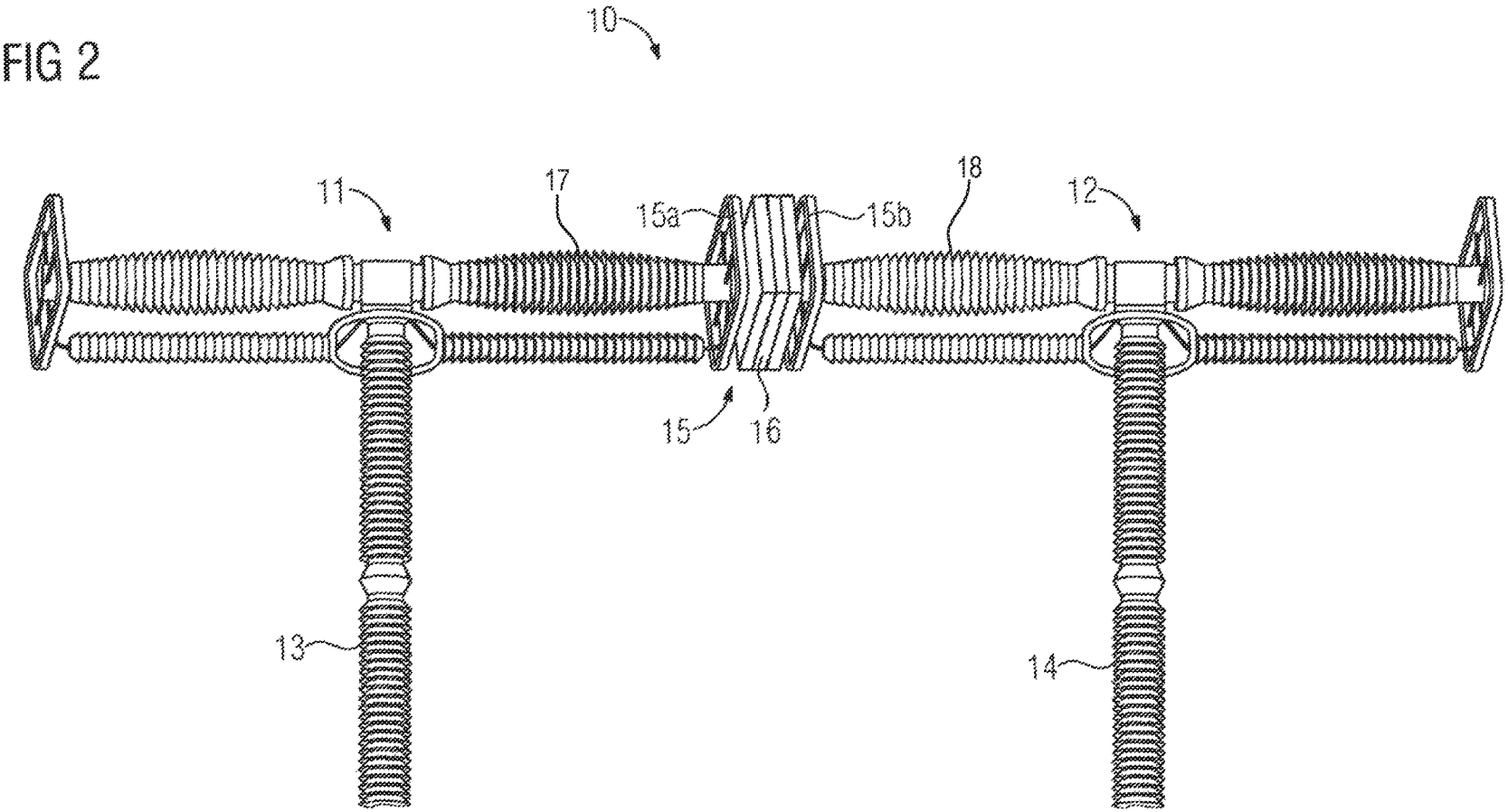
FIG. 2 illustrates a schematic view of an exemplary embodiment of a high-voltage system in accordance with the invention.

FIG. 2 illustrates a high-voltage system 10 that is a high-voltage switch gear in the present exemplary embodiment. The high-voltage system 10 comprises a first separating unit 11 and a second separating unit 12 that are insulated with respect to the ground potential by means of two supporting insulators 13 or 14 respectively. Electrical conductors 17, 18 are respectively connected between the separating units 11, 12 and the filed control device 15.

The high-voltage system 10 also comprises a field control device 15 that comprises two corona rings 15*a* and 15*b*. The two corona rings 15*a* and 15*b* delimit a weak-field spatial region in which an additional cooling body 16 is arranged. The cooling body 16 is equipped with cooling ribs with the result that its outer surface area is greatly enlarged with respect to the outer surface area of the corona ring 15*a*, 15*b*. This renders it possible to improve the dissipation of heat that is generated when the high-voltage system is being operated.

The cooling body 16 is merely illustrated in a schematic view in FIG. 2. The construction of the cooling body 16 may correspond by way of example to the construction of the cooling body 7 of the field control device 1 shown in FIG. 1.

The invention claimed is:

1. A field control device for a high-voltage system having an electrical conductor, the field control device comprising:

a shielding element for field control, said shielding element configured to be electrically conductively connected to the electrical conductor of the high-voltage system, said shielding element at least partly delimiting a spatial region having a weak electric field upon said shielding element being connected to the electrical conductor of the high-voltage system and said shielding element having an outer surface area; and a cooling body configured to be connected in a heat-conducting manner to the electrical conductor of the high-voltage system, said cooling body being disposed within said weak-field spatial region and said cooling body having an outer surface area being greater than said outer surface area of the shielding element.

2. The field control device according to claim 1, wherein said cooling body includes a ribbed structure increasing a size of said outer surface area of said cooling body.

3. The field control device according to claim 1, wherein said cooling body is a passive cooling body.

4. The field control device according to claim 1, wherein said cooling body includes a reflecting outer surface.

5. The field control device according to claim 1, which further comprises at least one heat-pipe element being connected in a heat-conducting manner to said shielding element and being configured to be connected in a heat-conducting manner to the electrical conductor of the high-voltage system.

6. The field control device according to claim 1, wherein said shielding element has at least one corona ring including a shielding ring and supporting elements connecting said shielding ring to the high-voltage system.

7. The field control device according to claim 6, wherein at least one of said supporting elements includes a heat-pipe element.

8. A high-voltage system, comprising:

an electrical conductor of the high-voltage system; and a field control device including a shielding element for field control;

said shielding element configured to be electrically conductively connected to said electrical conductor, said shielding element at least partly delimiting a spatial region having a weak electric field upon said shielding element being connected to said conductor and said shielding element having outer an surface area;

said field control device including a cooling body configured to be connected in a heat-conducting manner to the electrical conductor, said cooling body being disposed within said weak-field spatial region and said cooling body having an outer surface area being greater than said outer surface area of said shielding element.

* * * * *